United States Patent [19]

Logan, Jr.

[11] Patent Number: 4,651,358

[45] Date of Patent: Mar. 24, 1987

[54] APPARATUS FOR SECURING A PIVOTED MEMBER SUCH AS A TOILET SEAT LID

[76] Inventor: Emanuel L. Logan, Jr., 8984 Sidlelong Pl., Columbia, Md. 21403

[21] Appl. No.: 854,469

[22] Filed: Apr. 22, 1986

[51] Int. Cl.[4] ..... A47K 13/24

[52] U.S. Cl. ..... 4/253; 4/661; 16/333

[58] Field of Search ..... 4/253, 661, 251; 292/228, 258; 16/343, 333

[56] References Cited

U.S. PATENT DOCUMENTS

| | | | |
|---|---|---|---|
| 350,851 | 10/1886 | Taylor | 16/343 |
| 2,698,439 | 1/1955 | Bruckner | 4/253 |
| 2,996,731 | 8/1961 | Leptrone | 4/253 |
| 3,024,472 | 3/1962 | Hardenbrook | 4/253 |
| 4,479,273 | 10/1984 | Raden et al. | 4/253 |
| 4,524,470 | 6/1985 | Grenell | 4/253 |

*Primary Examiner*—Henry K. Artis

*Attorney, Agent, or Firm*—Millen & White

[57] ABSTRACT

An apparatus for locking the lid of a toilet includes a strut which is pivotted to the flush tank of the toilet and a coupling which is fixed to the lid. The coupling has a convoluted slot therein through which a portion of the strut is received. In order to unlock the lid one must simultaneously pivot both the lid and strut which requires manual dexterity not yet acquired by most toddlers and young children but possessed by adults and older children, thus protecting toddlers and young children from the dangers of flush toilets.

16 Claims, 8 Drawing Figures

APPARATUS FOR SECURING A PIVOTED MEMBER SUCH AS A TOILET SEAT LID7

BACKGROUND OF THE INVENTION

1. Field of the Invention

The instant invention relates to a apparatus for securing pivotted members such as toilet seat lids. More particularly, the instant invention relates specifically to a device for keeping lids on toilet seats closed, whereby the chance of a toddler opening the lid is minimized.

2. Prior Art and Technical Considerations

Commodes have long been a source of danger to toddlers and small children because many commodes contain a sufficient quantity of water to drown a small child if the child happens to fall into the commode head first. Moreover, commodes are frequently unsanitary and can be a source of disease transmission and infection. Accordingly, it is preferable to secure the lids of commodes in order to minimize the dangers inherent therein.

The prior art includes an extensive array of toilet lid latches however, these latches have not proved particularly satisfactory in that they are frequently expensive to manufacture, difficult to install and not entirely satisfactory in use. That this is a long-standing problem as is perhaps indicated by U.S. Pat. No. 735,927 to Woodruff wherein a chain and padlock are used to secure the lid of the commode. More modern approaches are exemplified in U.S. Pat. Nos. 4,524,470 and 4,479,273 wherein deflectable blocking arms are used to hold a lid against the toilet seat. The problem with this approach is that a great deal of force can be exerted when one lifts the seat, which force can easily break a plastic blocking arm. U.S. Pat. No. 3,395,408 discloses utilizing pairs of suction cups, one which holds the seat down and the other which holds the lid to the seat. Suction cups are notariously unreliable and frequently release too easily or seat too firmly. U.S. Pat. No. 2,996,731 discloses an articulated strut disposed between a toilet lid and toilet tank, which strut is held in place by suction cups. This however, is a complex device with springs and a multiplicity of moving parts which renders the device relatively expensive and difficult to install.

In view of these considerations, there is a need for a lid lock for commodes wherein the lid lock is inexpensive, easy to install, difficult for toddlers to manipulate, but easy for adults to manipulate.

SUMMARY OF THE INVENTION

It is an object of the instant invention to provide a new and improved latch or lock for holding a pivotted member such as the lid of a commode closed.

Upon further study of the specification and appended claims, further objects and advantages of this invention will become apparent to those skilled in the art.

The instant invention contemplates a strut which extends between one member, such as the lid of a commode, and another member such as the tank of the commode in order to secure same. Preferably, the strut is hinged to one member and releasably received in a coupling secured to the other member. The coupling has a convoluted slot therein which receives a portion of the strut. The convoluted slot requires pivoting of one member slightly with one hand and maneuvering the strut so as to exit through an opening in the coupling. The members can thereafter be pivotted with respect to one another.

The instant invention is particularly suitable for securing toilet seat lids against opening by toddlers and small children.

DESCRIPTION OF THE PREFERRED EMBODIMENT

Figure 1:
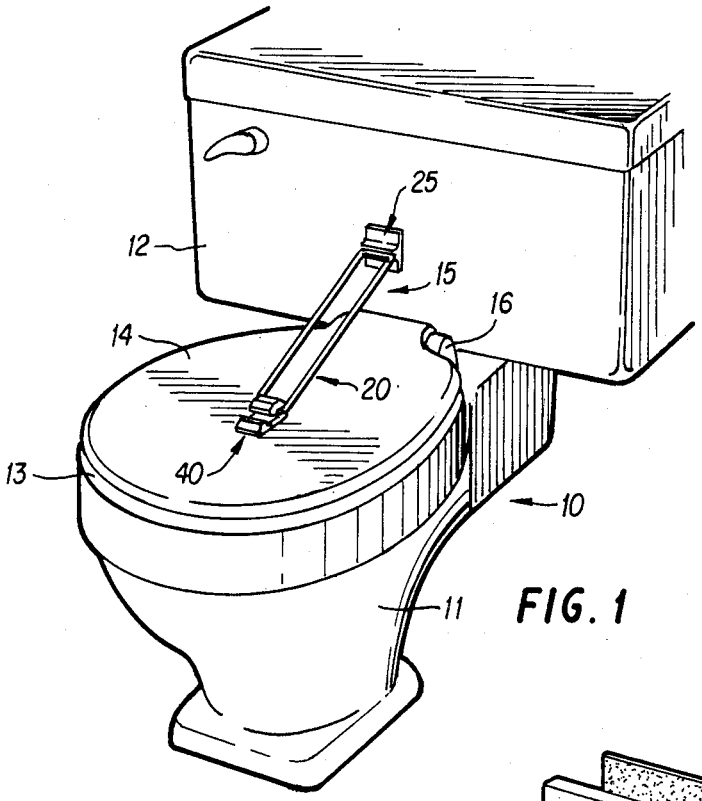
FIG. 1 is a prospective view of a latch for commode lids in combination with a commode in accordance with the principals of the instant invention.

Referring now to FIG. 1 there is shown a commode, designated generally by the numeral 10, having a bowl 11 and a flush tank 12. The bowl 11 has a seat 13 which is closed by a lid 14. In accordance with the principals of the instant invention, the lid 14 is kept closed over the seat 13 by a latch, designated generally by the numeral 15, which extends from the lid 14 to the tank 12 and prevents one from lifting the lid without first manipulating the latch. In accordance with the principals of the instant invention, the latch 15 cannot be disengaged without first lifting the lid 14 slightly and thereafter disengaging the latch. This is a difficult feat for a toddler to perform since it requires the toddler to coordinate two manual operations while observing the results of those operations. However, an older child or an adult can easily manipulate the lid 14 and latch 15 to open the lid so as to gain access to the toilet bowl 11.

Figure 2:
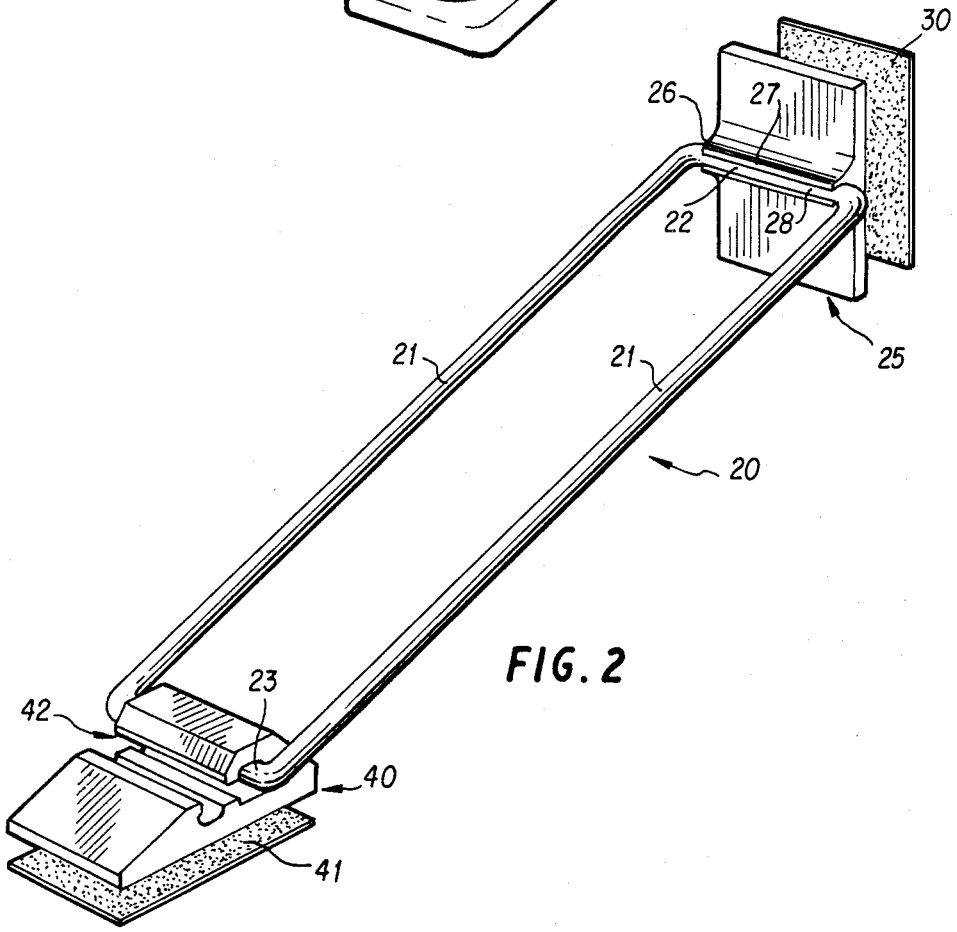
FIG. 2 is an enlarged prospective view of the latch of FIG. 1 showing the components thereof detached from the commode.
Figure 8:
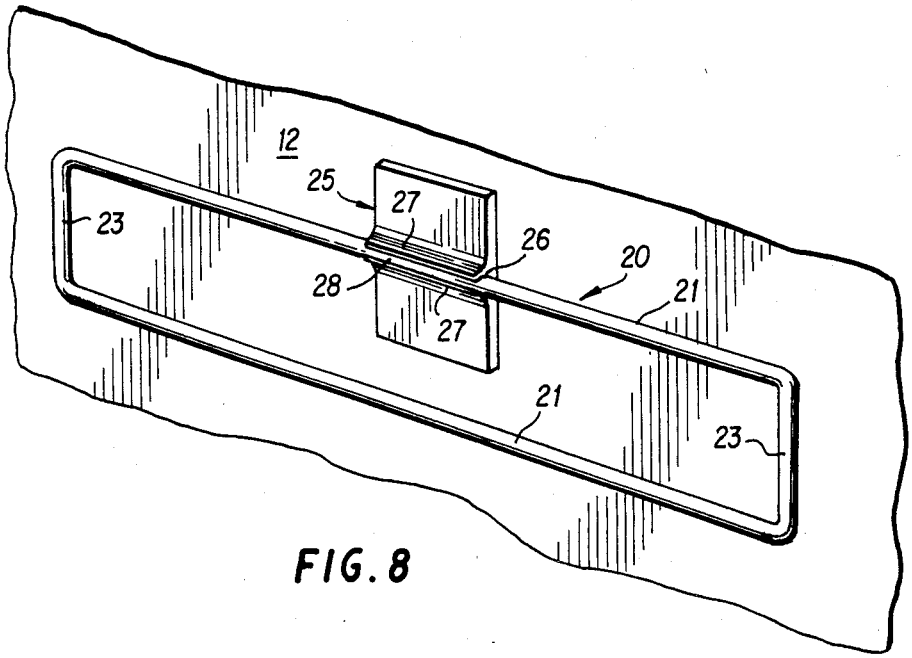
FIG. 8 is a prospective view showing how the strut is stored on the tank when not in use.

Referring now more specifically to FIG. 2, where the latch 15 is shown in greater detail, it is seen that the latch is comprised of a strut, designated generally by the numeral 20, in the form of a rectangular loop having a pair of longitudinal legs 21 and a pair of lateral legs 22 and 23. The strut 20 is formed of wire having a diameter of 0.177 inches. The loop has an inside length of 9.5 inches and an inside width of 1.5 inches. The lateral leg 22 is received in a single piece hinge, designated generally by the numeral 25, which hinge is made of a thermo plastic material, such as polyethylene or polyvinyl chloride. The hinge 25 has a journal 26 therein formed by a pair of projections 27 separated by a space 28. In accordance with the preferred embodiment, the hinge 25 has a height of 2.00 inches and a width of 1.50 inches; the journal 26 has a diameter of 0.2 inches; the slot 28 has a width of 0.17 inches, and the tops of the projections 27 form an angle of 60° with respect to one another. Consequently, the lateral leg 22 of the strut 20 can be easily securely snapped into the journal 26 of the hinge block 25. The hinge block 25 is adherred to the face of the tank 12 by an adhesive pad 30, which is preferably in the form of double-sided adhesive tape. The strut 20 can pivot from the locked position shown in FIG. 2 to the unlocked position shown in FIG. 4. In addition, the strut 20 can be removed from the hinge block 25 and stored thereon as shown in FIG. 8 with one of the longitudinal legs 21 retained within the journal 26.

The lateral leg 23 of the strut 20 is received in a coupling designated generally by the numeral 40. The coupling 40 is secured to the lid 14 of the commode 10 by a double sided adhesive pad 41 and has a length of about 2.0 inches and a width of about 1.25 inches. A convoluted slot, designated generally by the numeral 42, is provided in the coupling 40 to allow the lateral arm 23 of the strut 20 to enter the coupling.

Figure 6:
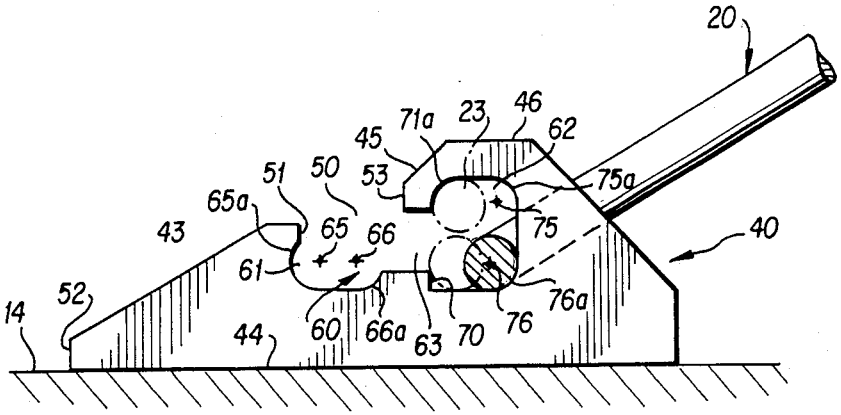
FIG. 6 is an enlarged side view showing how a coupling in accordance with the principals of the instant invention secures a strut when one attempts to unlatch the lid by lifting only the strut or only the lid.
Figure 7:
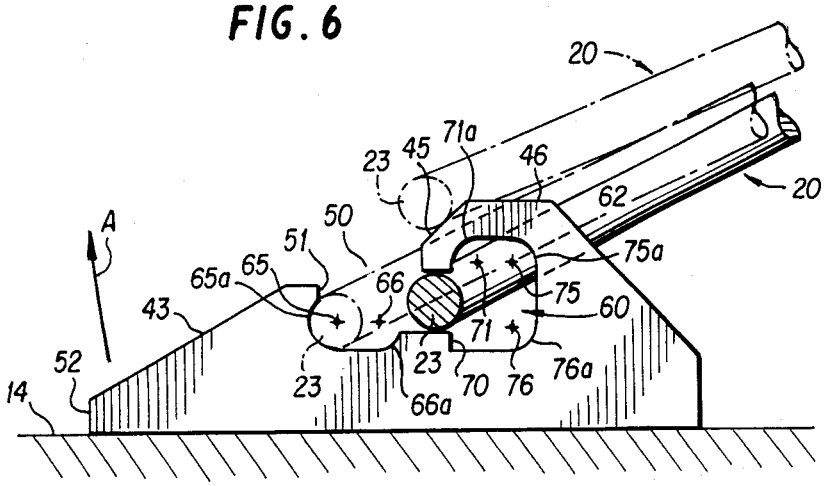
FIG. 7 is a side view, similar to FIG. 6 but showing how the latch remains latched when one attempts to open the commode lid by lifting on the lid without properly aligning the strut.

As is perhaps best seen in FIG. 6 and 7, the coupling 40 includes a front ramp 43 which is disposed at 30° with respect to the bottom surface 44 of the coupling and a second front ramp 45 which is disposed at an angle of 45° with respect to the top 46 of the coupling and the bottom surface 44. The ramps 44 and 45 are separated by a space 50 disposed between a first vertical wall 51, which is 0.75 inches from the end 52 of the coupling 40 and a second vertical wall 53 which is 1.10 inches from the end 52 of the coupling. The space 50 leads to a convoluted slot, designated generally by the numeral 60, disposed in the block 40. The convoluted slot 60 has a front recess, 61 and a rear recess 62 connected by a relatively narrow passage 63. The front recess has a radius of 0.1 inches forming surface **65*a* about point 65 at the front end thereof and a similar surface 66*a* having a radius, 0.1 inches about the point 66 at the rear end thereof. The radii points 65 and 66 are positioned approximately 0.35 inches from the base 44 and laterally spaced 0.1 inch from one another. As is seen in FIG. 7, the front surface 65*a* of the front recess 61 forms first abutment abutting the lateral leg 23 of the strut 20 so as to prevent the lid 14 from rising in the direction of arrow A. When closing the lid 14, the lateral leg 23 rides over the rear curved surface 66*a* before passing through the passage 63. The passage 63 is 0.22 inches in height so that the lateral leg 23, which is 0.177 inches in diameter, will pass easily therethrough if resting on the bottom surface of the slot. The rear recess 62 has an abrupt lower shoulder 70 and a curved upper shoulder 71*a* which has a radius of 0.1 inches about center line 71. If one attempts to lift the lid 14 while the lateral leg 23 is in the slot 62 the lateral leg 23 will abut a second abutment formed by the shoulder 70 and prevent lifting of the lid 14. If one lifts the strut 15 to the dotted line position shown in FIG. 6, without simultaneously lifting the lid 14, the lateral leg 23 abuts the surface 71*a* which forms a third abutment that again prevents one from lifting the lid 14. The rear wall of the recess 62 is defined by a pair of curved surfaces 75*a* and 76*a* generated about radii points 75*a* and 76, respectively. Each radius is approximately 0.1 inches. The radii points 75 and 76 are spaced 0.18 inches from one another and spaced 1.35 inches from the end 52 of the coupling 40**.

Figure 4:
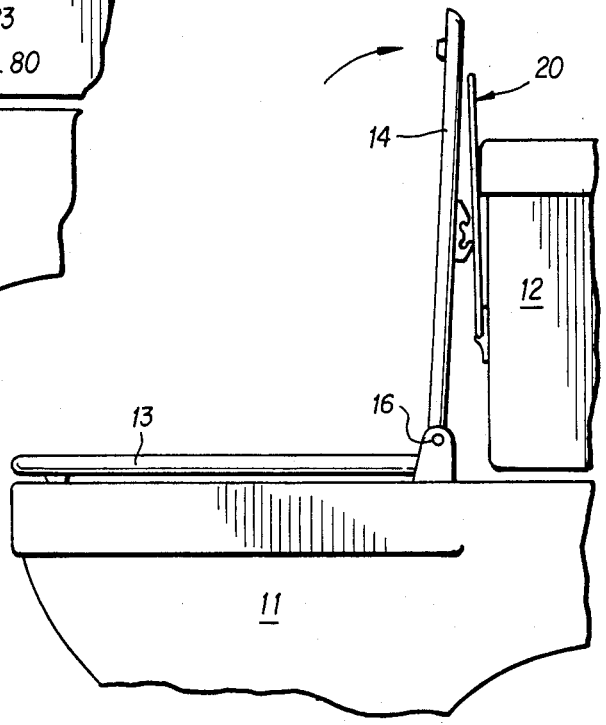
FIG. 4 is a view similar to FIG. 3 showing the lid of the commode in an open position.
Figure 5:
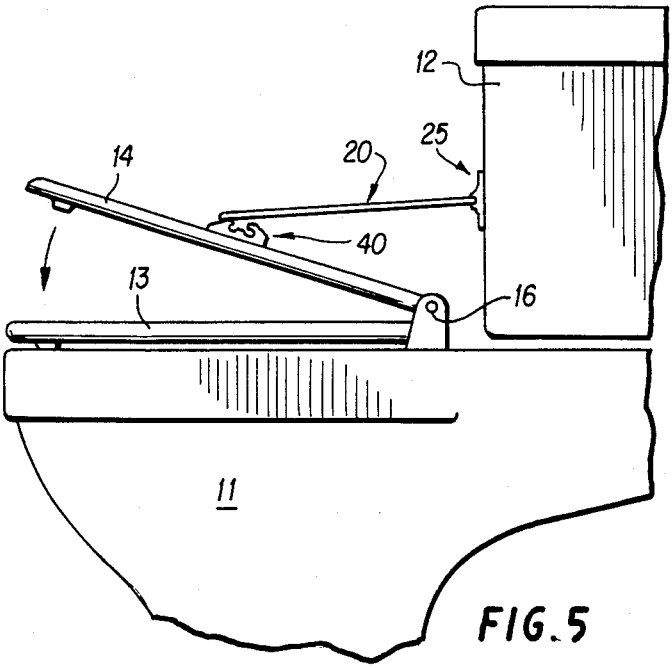
FIG. 5 is a side view similar to FIGS. 3 and 4 but showing the lid returning to its closed position and the latch returning to its closed condition.

In order to successfully unlatch the lid 14 from the latch 15, one must first lift the lid 14 slightly so that the lateral leg 23 of the strut 20 can pass through the space 63. Thereafter, one must continue to lift the lid 14 so as to align the lateral leg 23 with the space 50. The strut 15 can then be lifted free of the coupling 14 by passing the lateral leg 23 through the slot 50. As is seen in FIG. 4, the strut 15 pivots about hinge 25 so as to rest against the front face of the tank 12. The lid 14 can then pivot back against the tank with the coupling 40 received in the space between the longitudinal legs 21 of the strut 20.

When one lowers the lid 14, the lateral leg 23 of the strut 15 engages the front ramp 43 of the coupling 40 and rides thereon until it falls through the space 50 into the convoluted slot 60. Thereafter, the lateral leg 23 rides over the surface **66*a*, through the space 63 and comes to rest in the rear recess 62 so as to secure the lid 14 against lifting by toddlers while permitting easy access by older children and adults as is illustrated in FIG. 6 and 7**.

Figure 3:
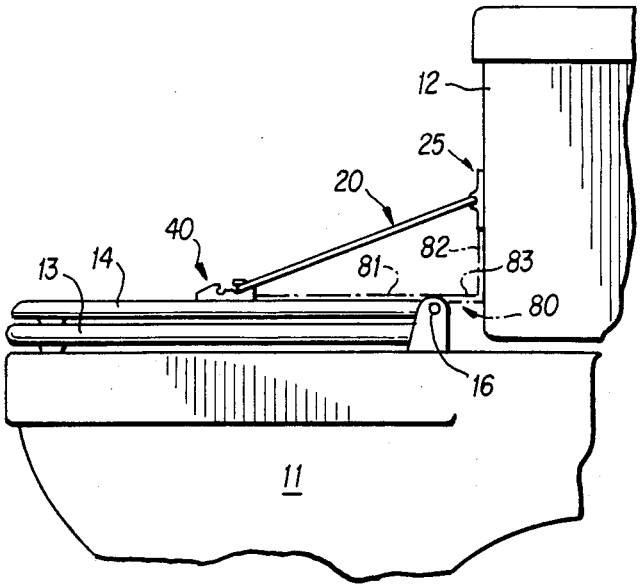
FIG. 3 is a side view of the latch of FIG. 1 showing the commode seat retained in the closed position.

In order to properly position the hinge 25 and coupling 40 on a commode, an L-shaped template 80 is provided with the latch 15. As is seen in FIG. 3, the template 80 has a long leg 81 and a short leg 82. The template is made of cardboard and may be part of the package in which the latch 15 is contained. Upon bending the cardboard along a line 83 and holding the leg 82 against the tank 12 and leg 81 on the lid 14, one can easily position the hinge 25 on the tank and the coupling 40 on the lid using the adhesive pads 30 to 41, respectively.

If the lateral leg 23 of the strut 20 rests on the rear ramp 45 of the coupling 40 when the lid 14 is closed as is seen in FIG. 7, then when the lid is pivotted, the lateral leg 23 will ride down the rear ramp 45 and through the opening 50 so as to be received in the convoluted slot 60. As one continues to pivot the lid 14, the lateral leg 23 will jamb against surface **65*a*, thus blocking further opening of the lid. When one releases the lid, the lateral leg 23 will enter the slot 62**.

As is seen in all the drawings the hinge 25 and coupling 40 each have constant cross-sections when the cross-section is taken through the dimension perpendicular to the sides of the hinge and coupling. Consequently, both the hinge 25 and coupling 40 may be formed by extruding thermoplastic material and cutting the extrusion at selected intervals spaced about 2.0 inches apart for the hinge and 1.5 inches apart for the coupling.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A locking apparatus for use with first and second members wherein the first and second members are pivoted with respect to one another for movement between a first position and a second position, whereby the locking device blocks selectively rotation of the members with respect to one another, the locking device comprising:

a. strut means for positioning between the first and second members to hold the first and second members in the first position;

b. hinge means for pivoting the strut means on one of the members, and c. coupling means on the other of said members, said coupling means having slot means therein for receiving a portion of said strut means, said slot means comprising first, second and third abutment surfaces wherein each abutment surface generally faces said hinge means, the first abutment surface being displaced furthest from said hinge means, the second abutment surface being between the first abutment surface and the hinge means and the third abutment surface being positioned above the second abutment surface and separated therefrom by a gap having a width slightly greater than the engaging portion of said strut, whereby the first and second members must be moved relative to one another while the position of the strut means is adjusted so as to align the strut with the gap in order to remove the strut means from the coupling means so that the members may be freely pivoted.

2. The apparatus of claim 1 wherein the coupling means has a front surface, the front surface having the opening therein for receiving the engaging portion of the strut means, recess means having the first and second abutment surfaces therein positioned in the keeper between the slot means and the hinge with the first abutment means positioned at the uppermost end of the slot means.

3. The apparatus of claim 2 wherein the second abutment means is a straight, flat shoulder positioned just beneath said gap and wherein said first and third abutment means have arcuate surfaces.

4. The apparatus of claim 1 wherein the strut member is configured as a loop having a width greater than that of the keeper and wherein the engaging portion of the strut means forms one end of the loop which engaging portion is received by the keeper.

5. The apparatus of claim 4 wherein the hinge means pivotally mounting the strut means has a slot therein defined by a pair of silent lips with a diameter less than the diameter of the strut means and wherein the strut means is releasably received in the slot means so that the strut means can be removed therefrom when not in use and reoriented therein for storage when not in use.

6. The apparatus of claim 5 wherein the front surface of the coupling means slopes upwardly toward the hinge means wherein once the strut means is removed from the slot, the strut means can slide along the front surface of the slot as the members are moved with respect to one another without hindering motion of the first and second members.

7. The apparatus of claim 6 wherein the front surface of the coupling means has first and second sloping portions, the second portion being on the side of the slot closest to the hinge means and sloping at an angle greater than the first portion, whereby the engaging portion of the strut means falls beneath the first portion of the front surface and through the slot after riding on the second sloping surface.

8. The apparatus of claim 1, wherein the coupling means and hinge means have adhesive surfaces attached thereto for attachment of the hinge means and coupling means to the first and second members.

9. The apparatus of claim 8 wherein the first member is a toilet tank with a vertically extending surface upon which the hinge means is mounted and wherein the second member is a toilet seat lid pivotted adjacent the flush tank for pivotal movement with respect thereto upon which the coupling means is mounted.

10. The apparatus of claim 9 further including a template, which template is configured in an L-shape for use in mounting the hinge means and coupling means, whereby one leg of the "L" has an end which locates the hinge means while the other leg of the "L" has an end which locates the coupling means so as to properly position the hinge means and coupling means on the toilet.

11. The apparatus of claim 10 wherein the diameter of the engaging portion of the strut means is smaller than but closely approximates the width of said gap, whereby a degree of dexterity is necessary to guide the engaging portion of the strut means through the gap.

12. An apparatus for securing a toilet seat lid member wherein the lid is pivotted adjacent to a member having a vertical surface, such as the face of a flush tank, the apparatus comprising:

strut means for extending between the members, the strut means having a first end positioned adjacent one member and a second end positioned adjacent the other member;

means for pivoting the first end of the strut means on one of the members, and coupling means positioned on the other member; the coupling means having a slot therein for receiving the second end of the strut means wherein the strut means is detachable from the coupling means through the slot, the slot having a convoluted portion requiring manipulation of both the lid and the strut means to remove the strut means from the slot.

13. The apparatus of claim 12 wherein the convoluted portion of said slot means comprises first, second and third abutment surfaces wherein each abutment surface generally faces said hinge means, the first abutment surface being displaced furthest from said hinge means, the second abutment surface being between the first abutment surface and the hinge means and the third abutment surface being positioned above the second abutment surface and separated therefrom by a gap having a width slightly greater than the engaging portion of the strut.

14. The apparatus of claim 13 wherein the hinge means is on the face of the toilet flush tank and wherein the coupling means is on the toilet lid seat.

15. The apparatus of claims 14 wherein coupling means and the hinge means have a constant cross-sectional shape taken perpendicular to one dimension thereof, whereby the hinge means and coupling means can be fabricated by extrusion and subsequent cutting perpendicular to that dimension.

16. The apparatus of claim 15 wherein the strut means is a rectangular loop of metal stock having an internal width greater than the width of the coupling and substantially equal to the width of the hinge.

* * * * *